United States Patent [19]

Chukhanov et al.

[11] 4,309,197

[45] Jan. 5, 1982

[54] METHOD FOR PROCESSING PULVERIZED SOLID FUEL

[76] Inventors: Zinovy F. Chukhanov, ulitsa Dmitria Ulyanova, 3, kv. 40; Zinovy Z. Chukhanov, ulitsa Obrucheva, 6, korpus 6, kv. 325; Sergei A. Tsuprov, B. Vuzovsky pereulok, 1, kv. 26; Vladimir I. Samsonov, Balaklavsky prospekt, 10, korpus 2, kv. 119; Vadim A. Karasev, Leninsky prospekt, 16, kv. 30, all of Moscow, U.S.S.R.

[21] Appl. No.: 75,335

[22] Filed: Sep. 13, 1979

[51] Int. Cl.[3] ..... C10J 3/46

[52] U.S. Cl. ..... 48/197 R; 48/202; 48/210; 201/4; 201/12; 201/16

[58] Field of Search ..... 48/210, 197 R, 202; 201/4, 12, 14, 16, 38

[56] References Cited

U.S. PATENT DOCUMENTS 2,924,556 2/1960 Jaeppelt et al. ..... 201/4

3,698,882 10/1972 Garrett et al. ..... 48/210

4,229,185 10/1980 Sass ..... 48/197 R

FOREIGN PATENT DOCUMENTS 1436963 5/1976 United Kingdom ..... 48/210

*Primary Examiner*—Peter F. Kratz

*Attorney, Agent, or Firm*—Lilling & Greenspan

[57] ABSTRACT

There is provided a method for processing a pulverized solid fuel by heat, which comprises the steps of drying said fuel and subjecting the latter to two-stage pyrolysis with the resulting formation of vapor, gaseous products and small coke. According to the invention, at least a part of the small coke is additionally heated to a temperature of 800° to 1500° C. by combustion gas and/or by partial burning of the small coke, whereafter the heated small coke is separated from the combustion gas, fed to the first stage of pyrolysis and for drying the fuel. The heated small coke is gasified by steam. The resultant gasification products are separated from the small coke which is then fed as the heat carrier to the first stage of pyrolysis.

5 Claims, 1 Drawing Figure

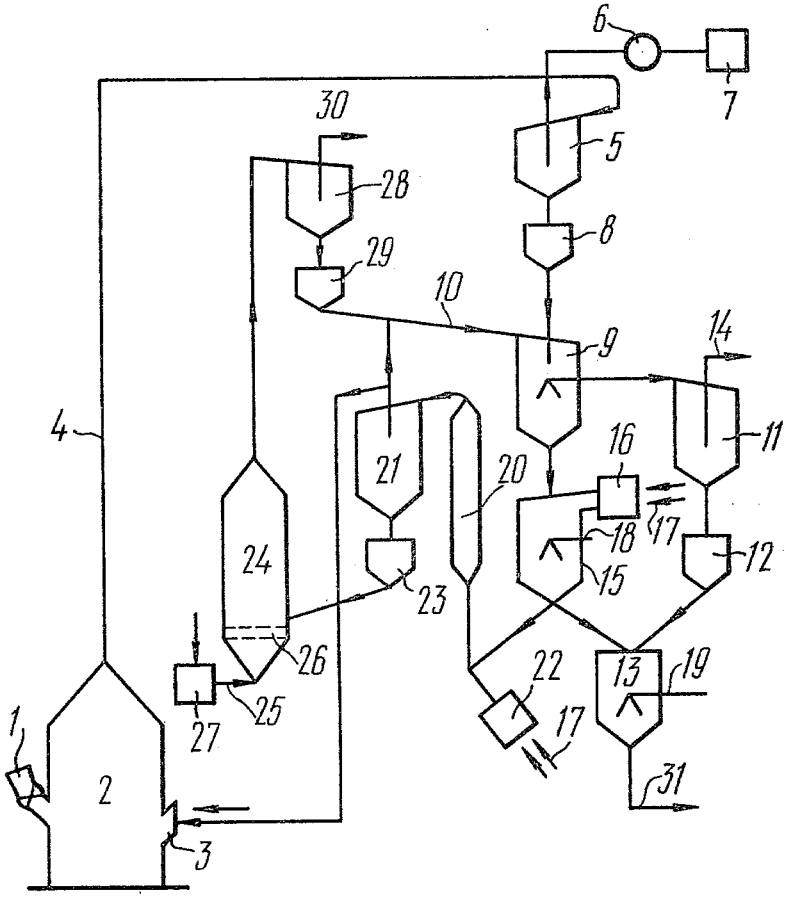
6
7
30
5
28
8
29
10
9
14
4
16
11
21
20
17
18
12
24
15
23
26
22
13
19
25
27
17
1
2
31
3

METHOD FOR PROCESSING PULVERIZED SOLID FUEL

BACKGROUND OF THE INVENTION

1. Field of the Invention

The present invention relates to comprehensive processing of various fuels, and in particular to a method for processing pulverized solid fuel by heat.

This invention can find wide application in the production of transportable fuels, electric power, chemical and commercial materials.

2. Description of the Prior Art

There is known in the art a method for processing a solid fuel, wherein corundum balls of 10 to 12 mm in diameter are used as the heat carrier for heating the fuel. The balls are preheated in the first chamber of a two-chamber reactor by furnace gases. The second chamber, having a heated solid heat carrier continuously fed thereinto from top, is used for heating, drying, coking and partial gasification of a pulverized solid fuel which, in a mixture with gas and vapor, flows upwardly through a dense layer of the heat carrier. The resultant commercial products are hot small coke, tar and gas (cf. Perepelitza A. L. et al. "Utilization of Solid Heat Carrier in the Flow Process of Continuous Coking of Coals in the Coal Fields of Irkutsk Region").

There is also known a method for processing a pulverized solid fuel, wherein a flow of pulverized fuel is fed upwardly. The fuel is heated by a downward countercurrent flow of larger-in-size particles of a solid heat carrier (sand, shot, etc.) immiscible with the fuel. Water vapor is fed together with the solid fuel to the reactor. Pyrolysis is effected simultaneously with the coal gasification process. The heat carrier is heated by combustion gas immiscible with the products of pyrolysis and gasification.

The above method is characterized by products of pyrolysis which mix with steam and blue gas, which complicate the clean-up and use of pyrolysis products, as well as the apparatus construction.

There is known a method for pyrolysis of pulverized solid fuel, such as coal, wherein the fuel is first, dried and then heated to a temperature of 500° C. in the first zone of pyrolysis by the heat evolved from combustion gas with the resultant formation of small coke and pyrolysis products. The small coke is fed to the second zone of pyrolysis to be heated therein to a temperature of 1000° C. by a gaseous heat carrier with the resultant formation of residual products of pyrolysis and small coke, their subsequent separation and collection as commercial products (cf. U.S.S.R. Inventor's Certificate No. 335,267).

The above-described method is characterized by a solid residue of fuel and small coke, resulting from pyrolysis and gasification, which is normally used together with tar in furnaces of a boiler incorporated in a power plant, and thus causes excessive slagging in the boiler and adds to the pollution of the environment as harmful refuse of sulfur, nitrogen oxides, as well as ash particles are disposed of. The yield of valuable products is negligible and, to make things worse, the products contain inert admixtures.

SUMMARY OF THE INVENTION

It is an object of the invention to enhance the operating process simultaneously with an increase in the yield and improved quality of the end product.

Another object of the invention is to eliminate the possibility of slagging due to occur in boilers of power plants and to reduce the amount of harmful gases vented to the atmosphere.

These and other objects and features of the invention are accomplished by the provision of a method for processing pulverized solid fuel by heat, comprising drying said fuel, subjecting it to two-stage pyrolysis with subsequent formation of vapor, gaseous products and small coke, effecting additional heating of at least some quantity of the small coke to a temperature of 800° to 1500° C. by combustion gas and/or by partial burning of the small coke, separating the heated small coke from the combustion gas fed at the first stage of pyrolysis and for drying the fuel, gasifying the heated small coke by water vapor with the resultant separation of the small coke from gasification products, collecting the small coke for further use as the heat carrier in the first stage of pyrolysis.

The method according to the invention for processing pulverized solid fuel is highly effective, featuring enhanced power efficiency (up to 84–88%) with the comprehensive utilization of fuel as the starting material for chemical, industrial and public-utility use. In addition, the method of the invention permits the temperature potential of the heat carrier to be effectively used, thereby enhancing the process efficiency. The use of small coke, cooled during gasification, as the solid heat carrier for pyrolysis makes it possible to conduct pyrolysis at more favorable temperature conditions, i.e. at a lower drop of temperature between the heat carrier and the apparatus for effecting the first stage of pyrolysis, which, in turn, results in a higher yield of the most valuable liquid products of a high-speed pyrolysis.

Since the amount of small coke fed for gasification is determined by the heat balance of the water-gas gasifier, water vapor has a high degree of decomposition, resulting in an enhanced efficiency of water gas.

It is advantageous to use pulverized solid fuel with the particle size thereof being not more than 1.5 mm, which makes it possible to intensify the operating process and improve quality of pyrolysis products. The gasification process is preferably carried out with a controlled flow rate of water vapor, which allows for automatic control of the water-gas discharge, elimination of excessive consumption and undesired accumulation of small coke in an apparatus.

BRIEF DESCRIPTION OF THE DRAWING

The invention will now be described by way of example only with reference to the accompanying drawing which shows schematically the preferred process flow of a method for processing pulverized solid fuel.

DESCRIPTION OF THE PREFERRED EMBODIMENT

Referring now to the drawing, there is shown therein the process flow according to which a finely divided solid fuel, such as coal, with a particle size of preferably 1.5 mm is fed from a bin 1 to a shaft mill 2 to be dried therein by a drying gaseous agent, preferably free from oxygen, which is introduced to the mill 2 through a connecting pipe 3. The gaseous suspension is flown through a pipe 4 to a cyclone 5 wherein the dry fuel is separated and the dust-free drying agent with the fuel moisture is introduced through a ventilator 6 to the furnace of a boiler 7 incorporated in a power plant.

The dry fuel is introduced through a dust-controlled intermediate bin gate 8 to a first-stage apparatus 9 for pyrolysis, wherein the fuel is heated to a temperature of 500° to 800° C. by a mixed (solid and gaseous) heat carrier fed thereinto through a pipe 10. Pyrolysis products together with a small amount of entrained small coke dust are then flown to a cyclone 11 wherein the small coke dust is separated to be thereafter delivered to intermediate bins 12 and 13 for further use as the heat carrier for pyrolysis or else as commercial fuel product.

A gas-vapor mixture is removed from the cyclone 11 through a pipe 14 to be thereafter passed to a condensation and purification system wherein valuable commercial liquid products and gas are collected for further use.

From the apparatus 9 the small coke is transferred to a second-stage apparatus 15 for pyrolysis to be heated therein to a temperature of 600° to 1100° C. by a gas burner 16 operating on gas fed together with the air through inlets 17. Gas is discharged from the second-stage pyrolysis apparatus 15 and bin 13 through connecting pipes and gas vents 18, 19.

The hot small coke is passed from the second-stage pyrolysis apparatus 15 to a process furnace 20 connected with a cyclone 21. It is possible to supply only a part of hot small coke from the second-stage pyrolysis apparatus 15 to the process furnace 20, with the remainder part of the hot small coke being removed through the bin 13 for use as commercial product. The bulk amount of gaseous heat carrier, which heats and delivers the small coke—solid heat carrier—through the furnace 20 to a cyclone 21, is fed to the furnace 20 through a burner 22.

The small coke, separated at a temperature of 800°–1500° C. in the cyclone 21, is fed via an intermediate bin 23 to a watergas gasifier 24 wherein a predetermined amount thereof is gasified by means of used water vapor introduced therein along a pipe 25 through a baffle 26, this being effected by means of a regulator 27 in a manner well known to those skilled in the art and as described in the book under the title "Fuel Control at Power Plants" by A. A. Andreev, B. C. Beloselskiy, M. N. Krasnoff, Energia Publishers, Moscow, 1973. Steam is converted in the gasifier 24 into water gas having a high calorific value and, therefore, being valuable chemical material and fuel. Gaseous suspension of water gas and small coke is fed from the gasifier 24 to a cyclone 28 wherein the small coke is separated from the water gas and is then passed as the solid heat carrier through a bin 29 to the pipe 10 to be mixed therein with the first portion of gas discharged from the cyclone 21. The remainder portion of gas is passed from the cyclone 21 through the connecting pipe 3 for use as a drying agent for drying the solid fuel.

This mixture, which can be otherwise termed as mixed heat carrier, is fed to the first-stage pyrolysis apparatus 9, thereby closing the entire cycle. Small coke and combustion gas can be fed separately to the first-stage pyrolysis apparatus 9.

Water gas (mainly hydrogen and carbon oxides) is passed from the cyclone 28 along a pipeline 30 for purification, whereafter it is delivered to a user, for example, such as power plant, chemical reactor for the production of hydrogen, synthesis gas, methanol or other products. With the method of the invention it becomes possible to produce extremely cheap water gas, since an excessive amount of small coke in the gasifier 24 enables a high degree of steam decomposition (up to 80–95%) and a high power efficiency thereof, thereby simplifying the entire system. Automatic control over the gas-making process, process temperature and control over the amount of the circulating solid heat carrier is effected by altering the way in which the small coke is removed from the process through the intermediate bin 13 and further along a pipe line 31 and by passing steam to the gasifier 24 with due regard to a possible change in the quality of fuel and operating conditions of a power unit. The distinctive feature of the invention is that passing to the boiler furnace of a power unit together with a drying agent is not only a flow of pulverized solid fuel but gases as well which are completely free of sulphur and solid inclusions of fuel, thus enabling boilers to operate on gas and, practically, eliminating the possibility of slagging on the heating surfaces. This method is exceptionally effective where peat as well as high-moisture peat is utilized. In addition, it becomes possible to considerably reduce the boilers in size.

Temperature conditions of pyrolysis and gasification are controlled by altering the amount and temperature of the gaseous heat carrier obtained in the gas burners 22, 16.

Since the drying agent fed to the boiler 7 together with gases contains a great amount of steam formed in the course of drying the above fuel, the combustion temperature is lowered, and the content of harmful nitrogen oxides in combustion gas sharply decreases at the expense of both internal (produced in the furnace during combustion of nitrogen) and external (produced from the nitrogen contained in fuel) nitrogen oxides produced in the course of processing the above fuels at a power and process fuel treatment plant. This factor makes it possible not only to assure comprehensive utilization of the fuel, but to almost completely eliminate the possibility of environmental contamination by waste products, both gaseous (sulphur and nitrogen oxides) and solid (ash particles), vented to the atmosphere from such a plant.

The method of the present invention permits the use of low-grade liquid fuels which are introduced either into a process furnace or water-gas gasifier depending on the ultimate use of water gas.

The invention will be further described with reference to the following illustrative examples.

EXAMPLE 1

Let us now consider the operation of a power and process fuel treatment plant utilizing coal. The production capacity of a single unit is 500 t of raw coal per hour.

Raw coal with a calorific power of 3560 kcal/kg, containing 35 percent by weight of moisture, 6.5 percent by weight of ash and 48 percent by weight of volatile matter, was subjected to processing by heat treatment. Coal was fed from the bin /I/ to the dryer (2) with 95 kg of hot (at 1050° C.) oxygen-free drying agent being introduced therein through the connecting pipe (3) per each 100 kg of coal. The coal was dried and finely divided (with a mesh size of 100 microns, 20 wt.%). At a temperature of 200° C. the dry coal was separated in the cyclone (5) from gas containing 35 kg of coal moisture vapor, 95 kg of drying agent and 0.3 kg of coal dust.

The dry coal in an amount of 65 kg was fed through the intermediate bin 8 to the first-stage pyrolysis apparatus 9 to be heated therein to a temperature of 700° C. by a mixed (small coke and gas) heat carrier passing from the cyclones 21, 28 of the process furnace (20) and the water-gas gasifier (24), respectively. Small coke in an amount of 156 kg at a temperature of 850° C. and 32.5 kg of gaseous heat carrier were fed to the first-stage pyrolysis apparatus (9). The final stage of the coal pyrolysis process was conducted at a temperature of 780° C. in the second-stage pyrolysis apparatus (15).

Produced from 65 kg of coal fed to the apparatus for pyrolysis are 29.8 kg of gas-vapor mixture and 35.2 kg of small coke. The small coke is separated from the gas-vapor mixture to be thereafter delivered to a condensation and purification system.

Also produced in the course of pyrolysis of coal are 18.3 kg of pyrolysis gas, 8 kg of tar, 0.5 kg of gas benzine and 3 kg of pyrogenic water.

The pyrolysis gas has a heating value of 4850 kcal/$m^3$ and the following composition, in volume percentage: $CO_2$, 22; CO, 27; $H_2$, 20; $CH_4$, 21; and other hydrocarbons, 10. Converted into pyrolysis gas are 81200 kcal, and into tar and gas benzine, 67800 kcal. Converted into the small coke 35.2 kg, formed during the cola pyrolysis, are 63 percent of potential heat evolved from the coal or 58 percent of the heat supplied to a power unit. Final heating of the small coke in the second-stage pyrolysis apparatus (15) is effected by burning gas taken in an amount of 1.5 kg and small coke in an amount of 2.2 kg. Commercial small coke was produced in an amount of 14.4 kg (12 kg of carbon). In addition, to the heat carrier (small coke) fed to the pyrolysis apparatus in an amount of 156 kg, the furnace receives 8.3 kg of small coke while 6.7 kg of the newly produced small coke are heated to a temperature of 800° C.

Once heated in the process furnace (20), the small coke is then separated from the gaseous heat carrier to be fed to the water-gas gasifier (24) wherein 24 kg of water vapor (according to reaction $H_2O+C$) are produced from water vapor /18 kg/ and an excessive amount /156+6/ of 162 kg of small coke. Water vapor is separated in the cyclone (28) from the small coke and is then cooled to be afterwards delivered for purification and further use in a power and processing plant as a commercial product for the production of hydrogen, reducing gas and synthesis gas.

The gaseous heat carrier (semiwater-gas) is produced in the process furnace /20/ wherein 43 kg of air are introduced through the burner 22 to enable combustion of gas and small coke. After the solid heat carrier is separated in the cyclone /21/, the semiwater-gas is used as the gaseous heat carrier. Depending on the controller flow rate of water gas, a part of semiwater-gas in an amount of 19 kg is fed as the drying gas to the drying chamber 2 through the connecting pipe 3. The drying agent is fed to the furnace of the boiler 7 is an amount of 95 kg, of which 19 kg constitutes semiwater-gas and 76 kg of combustion gas from the power plant boiler.

Produced from 100 kg of coal, 18 kg of water vapor, 76 kg of drying agent and 43 kg of air are 8.5 kg of tar and benzine gas, 18.3 kg of pyrolysis gas, 24 kg of water gas, 52 kg of semiwater-gas, 14.4 kg of pyrogenic water, 35 kg of coal moisture, 95 kg of drying agent (inclusive of 19 kg obtained from 52 kg of semiwater-gas), and 4.1 kg of slag with ash.

EXAMPLE 2

This example is given to illustrate the embodiment of the invention preferable for use where the production of commercial small coke is undesirable by reason of its high content of ash, sulphur, etc. To this end, water vapor is fed to the water-gas gasifier /24/ in an amount exceeding two-fold that given in Example 1, whereas the small coke is no longer removed as commercial product through the outlet 31. The small coke is heated in the process furnace /20/ to a temperature of 1500° C. Fed per 100 kg of coal are 76 kg of drying agent and 82 kg of air. The resultant output of the power-and-process unit amounts to 8.5 kg of tar and gas benzine, 18.3 kg of pyrolysis gas, 48 kg of water gas, 95 kg of drying agent, 3 kg of pyrogenic water, 35 kg of coal moisture and 6.5 kg of slag with tar. Ecologically, this example is more effective. There is no alternative for fuels high in ash content.

What is claimed is:

1. A method for processing a pulverized solid fuel, consisting essentially of:

(a) drying said fuel with a hot gas introduced at a rate sufficient to form a gaseous suspension containing a dry particulate fuel fraction and a volatile moisture containing fuel fraction;

(b) separating and removing the entire volatile moisture containing fuel fraction from the gaseous suspension and feeding it to a power plant fuel supply, thereby leaving a residue of dry particulate fuel;

(c) subjecting the entire residue of dry particulate fuel to a first stage pyrolysis to form a first gas-vapor product, which is separated, removed and condensed, and a first residue of small coke;

(d) subjecting the entire first residue of small coke from step (c) to a second stage pyrolysis to form a gaseous product which is separated and removed, and a second residue of small coke;

(e) introducing a portion of the second residue of small coke from step (d) into a gas fired furnace and heating to a temperature of about 800°–1500° C. to form a third residue of heated small coke and a hot flue gas; the remaining portion of said second residue of small coke from step (d) being removed as a product;

(f) separating the third residue of heated small coke in step (e) from the hot flue gas;

(g) recycling a portion of said hot flue gas, as a gaseous heat source, to the first stage pyrolysis in step (c), and recycling the remaining portion to step (a) to serve as the hot drying gas;

(h) introducing said entire third residue of heated small coke from step (f) to a water-gas gasifier wherein a suspension consisting essentially of volatile water-gas and a fourth residue of heated small coke are formed;

(i) separating and removing the water-gas, and recycling the entire fourth residue of coke from step (h) to the first stage pyrolysis in step (c) to serve as a solid heat source for said pyrolysis.

2. A method as claimed in claim 1, wherein the pulverized solid fuel used has a particle size of not more than 1.5 mm.

3. A method as claimed in claim 1, wherein the gasification process is effected with the controlled flow rate of steam.

4. A method as claimed in claim 1, wherein the temperature of step (c) is about 500°–800° C.

5. A method as claimed in any of claims 4 or 1, wherein the temperature of step (d) is about 600°–1100° C.

* * * * *